United States Patent [19]

Takada et al.

[11] Patent Number: 4,859,291

[45] Date of Patent: Aug. 22, 1989

[54] METHOD OF PERFORMING INDUSTRIAL LOW HYDROGEN EMBRITTLEMENT NICKEL PLATING BY USE OF AN INSOLUBLE ANODE

[75] Inventors: Koji Takada, Nagoya; Masaya Miyata, Isahaya; Isojiro Tamura, Oyamacho, all of Japan

[73] Assignee: Katsukawa Micarome Industrial Co. Ltd., Japan

[21] Appl. No.: 302,020

[22] Filed: Jan. 25, 1989

Related U.S. Application Data

[63] Continuation-in-part of Ser. No. 181,081, Apr. 13, 1988, abandoned.

[30] Foreign Application Priority Data

Apr. 28, 1987 [JP] Japan ..... 62-103374

[51] Int. Cl.[4] ..... C25D 3/12

[52] U.S. Cl. ..... 204/49; 204/16

[58] Field of Search ..... 204/49, 16

[56] References Cited

U.S. PATENT DOCUMENTS

| | | | |
|---|---|---|---|
| 2,331,751 | 10/1943 | Wesley et al. | 204/49 |
| 3,488,264 | 1/1970 | Bailey et al. | 204/49 |
| 4,045,304 | 8/1977 | Tezuka | 204/49 |
| 4,411,744 | 10/1983 | Rosegren et al. | 204/49 |

OTHER PUBLICATIONS

W. A. Wesley et al., "Nickel Plating with Insoluble Anodes", a paper presented at AES Convention, (1951).

*Primary Examiner*—G. L. Kaplan

*Attorney, Agent, or Firm*—Kane, Dalsimer, Sullivan, Kurucz, Levy, Eisele and Richard

[57] ABSTRACT

Disclosed is a method of industrial low hydrogen embrittlement nickel plating by using an insoluble anode, comprising the steps of preparing a plating bath composed of only nickel sulfate, sodium sulfate and boric acid, and performing plating in the plating bath while making electrolysis by using a lead anode as the insoluble anode and while supplying nickel carbonate slurry into the plating bath to thereby cause the nickel carbonate to dissolve in a plating solution in the plating bath under the control of pH of the plating solution, and further disclosed is a steel-formed matter which is plated by the method described above.

2 Claims, 1 Drawing Sheet

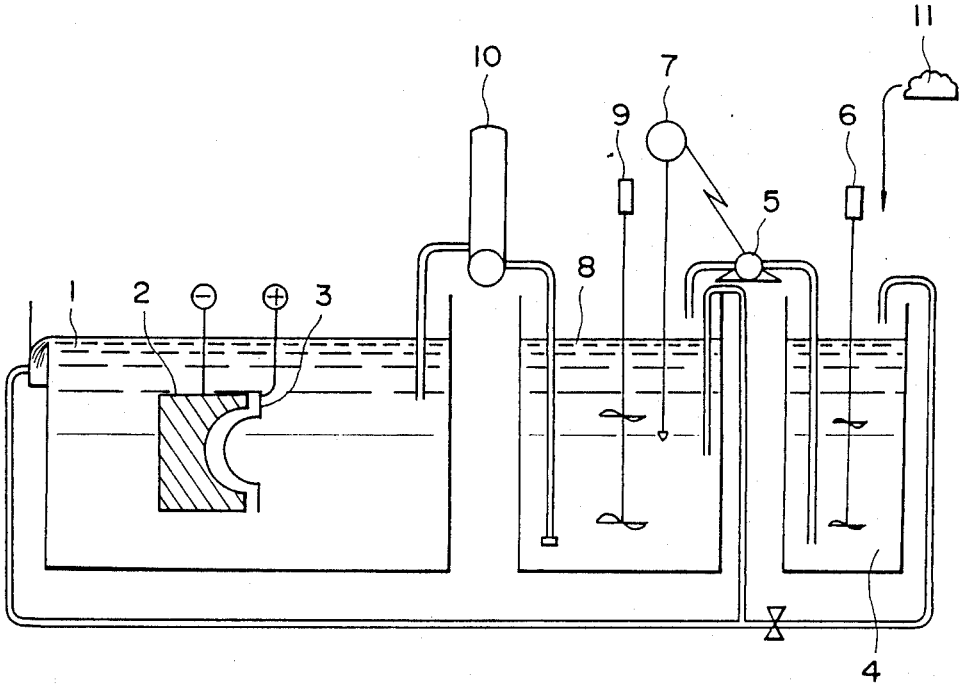
11
10
7
9
6
5
8
1
2
3
4

METHOD OF PERFORMING INDUSTRIAL LOW HYDROGEN EMBRITTLEMENT NICKEL PLATING BY USE OF AN INSOLUBLE ANODE

CROSS-REFERENCE TO RELATED APPLICATION

This application is a continuation-in-part of our copending U.S. patent application Ser. No. 181,081 filed Apr. 13, 1988 and now abandoned.

BACKGROUND OF THE INVENTION

1. Field of the Invention

The present invention relates to industrial nickel plating mainly used for repair of aircraft components and so on, and particularly relates to industrial nickel plating used in the field where it is required to perform plating on a complicated-shaped object to be plated with a uniform and heavy thickness.

2. Description of the Prior Art

In overhauling aircraft components such as landing gear components made of ultra high strength steel, when occurrence of corrosion or cracks in a surface portion of the components is found, the portion is mechanically removed out and repaired by industrial nickel plating. In the conventional technique, repair plating has been carried out mainly by use of a nickel sulfamate bath with a soluble nickel anode. Most of aircraft components are, however, complicated in shape, and it is required to achieve the plating on the selected portion. Therefore, a suitable conforming anode is indispensable. In this case, however, there has been a problem that the fabrication of the conforming anode is difficult and expensive, since the mechanical fabrication of nickel is difficult and expensive. Moreover, since the nickel sulfamate bath tends to form pitting (pin holes) in the plated surface, the use of an organic anti-pitting agent is indispensable. However, there has been a problem that if the organic anti-pitting agent decomposes and changes in its properties during plating operation, the physical properties of the plating deposit are deteriorated and therefore it is required to intermittently carry out the activated charcoal treatment and filtration to thereby eliminate organic impurities so that the maintenance control of the bath is expensive and not easy. There has been a further problem in that the conventional sulfamate nickel plating causes hydrogen embrittlement in ultra high strength steel, which has an ultimate tensile strength of 260 kilo pound per square inch (KSi), and in order to eliminate the absorbed hydrogen, it is required to carry out a hydrogen relief baking treatment for a minimum of 23 hours so that the process takes excessive time and becomes expensive.

SUMMARY OF THE INVENTION

It is therefore an object of the present invention to solve the foregoing problems in the prior art.

It is another object of the present invention to provide a method of industrial nickel plating which makes it possible to easily apply nickel plating of superior physical properties to a substrate to be plated having a complicated-shape.

Through various investigations to solve the foregoing problems, the inventors of this application have found that it is possible to easily produce a conforming anode having a desired shape if lead is used as a material for an insoluble anode. It is impossible, however, to use lead because lead is anodically corroded in the nickel sulfamate bath. Moreover, a bath such as a Watt's bath, containing halogen salt such as nickel chloride, corrodes lead anodically, and therefore the bath is also unsuitable. Accordingly, a total sulfate bath which does not contain any halogen salt is used as the plating bath according to the present invention. That is, the inventors have found a novel method of industrial nickel plating in which a plating bath which contains nickel sulfate, sodium sulfate and boric acid and eliminates any organic additive agents as a bath composition is used, and in which a lead conforming anode is used to perform plating. However, when electrolysis is performed by using an insoluble anode, sulfuric acid is produced with electrodeposition of nickel to thereby lower the pH of the bath. Accordingly, the inventors have solved the problem of pH reduction in the above-mentioned method of industrial nickel plating in a manner so as to perform plating while automatically supplying a nickel component by pouring a slurry-like material which is prepared by adding nickel carbonate to the plating solution, under the pH control. Further, as the result of studies, the inventors have confirmed that the nickel plating according to the present invention does not cause hydrogen embrittlement in ultra high strength steel which is extremely susceptible to hydrogen embrittlement.

BRIEF DESCRIPTION OF THE DRAWING

Other features and advantages of the present invention will be apparent from the following description taken in connection with the accompanying drawing, wherein the single FIGURE is a diagram illustrating the method of industrial nickel plating according to the present invention.

In the accompanying single FIGURE, the reference numeral 1 designates a plating tank, 2 a substrate to be plated, 3 a conforming anode made of lead, 4 a nickel carbonate slurry tank, 5 a measuring pump, 6 agitator, 7 a pH controller, 8 a nickel carbonate dissolving tank, 9 an agitator, 10 a filter pump, and 11 a nickel carbonate cake.

DETAILED DESCRIPTION OF THE INVENTION

Here, the present invention will be described more in detail.

The plating bath used in the present invention is composed of 200~350 g/l nickel sulfate, 20~150 g/l, preferably 40–120 g/l, sodium sulfate and 30~50 g/l boric acid and it is a constituent subject that the plating bath does not contain any organic additive agents.

The nickel plating bath must not contain any halogen salt such as nickel chloride, nickel bromide or the like, or any organic material such as anti-pitting agent, brightener, stress reducer or the like, unlike the conventional nickel plating bath.

The anode used in the present invention is a conforming anode which is made of a lead plate, a lead bar, a lead wire, etc. to a desired-shaped.

In the accompanying single drawing, the reference numeral 1 designates a plating tank, 2 a substrate to be plated, 3 a conforming anode made of lead, 4 a nickel carbonate slurry tank, 5 a measuring pump, 6 agitator, 7 a pH controller, 8 a nickel carbonate dissolving tank, 9 an agitator, 10 a filter pump, and 11 a nickel carbonate cake.

According to the present invention, as shown in the drawing, the dissolving tank 8 connected to the plating tank 1 is provided with the pH controller 7. Nickel carbonate slurry in the nickel carbonate slurry tank 4 is poured into the nickel carbonate dissolving tank 8 through the measuring pump 5 associated with the pH controller 7 and dissolved with agitation by the agitator 9 while controlling the pH in the dissolving tank 8 so as to keep the pH at 2~5, preferably 3~4. The solution in the dissolving tank 8 is circulated to the plating tank 1 through the filter pump 10 so that the plating operation is carried out while keeping the pH of the plating bath and concentration of nickel in the plating bath constant under control.

According to the present invention, the nickel carbonate is particularly preferably used in the form of the nickel carbonate cake 11. That is, an equivalent amount of sodium carbonate is added to nickel sulfate solution and the resultant precipitate of nickel carbonate is dehydrated by a filter press or a centrifuge to obtain the dehydrated cake-like nickel carbonate 11. The dehydrated cake-like nickel carbonate 11 is added to the plating solution in the nickel carbonate slurry tank 4 and mixed by the agitator 6 so as to be made into the form of slurry-like nickel carbonate. When the pH of the solution in the dissolving tank 8 becomes low, the slurry-like nickel carbonate in the nickel carbonate slurry tank 4 is added into the plating solution in the dissolving tank 8. The nickel carbonate can be immediately dissolved in the plating solution because it is in the form of slurry.

As the result of studies, the inventors have found that the use of an insoluble anode made of lead as a conforming anode suitable to a complicated-shaped substrate to be plated such as an aircraft component brings about not only such an effect that the industrial nickel plating can be carried out easily and inexpensively but an unexpected superior effect as follows. That is, by the hydrogen embrittlement test of ASTM F519, it has been confirmed that the nickel plating according to the present invention does not cause hydrogen embrittlement in ultra high strength steel having extremely high hydrogen embrittlement susceptibility. It has been proved that the nickel plating layer according to the present invention has extremely superior physical properties. Specifically, the internal stress in the electrodeposited nickel layer is so low to be +350~+600 kg f/cm$^2$ (tensile stress) that can stand comparison with the plating method by use of a nickel sulfamate plating bath which is especially superior among conventional plating methods, the micro Vickers hardness is 200~250, the tensile strength is 80~100 kg f/mm$^2$ and the elongation is 8~10%. Those physical properties satisfy the requirements of Aerospace Materials Specification AMS 2424 and Boeing specification BAC 5746, and the plating according to the present invention has a performance adequate to an industrial nickel plating to be used for repair of ultra high strength steel aircraft components. Further, it has been found that there is another unexpected effect in the present invention that pitting is not formed on the surface of electrodeposited nickel at all. In nickel plating, generally, in which either a Watt's bath or a nickel sulfamate bath is used, pitting tends to be formed in the plated surface, and therefore the use of an organic anti-pitting agent having surface activity to lower the surface tension of plating solution is indispensable. It has been proved, however, that in the plating method according to the present invention, there is a further effect that an extremely smooth plated surface with no pitting can be obtained without adding such an organic anti-pitting agent.

The present invention will be more clearly understood with reference to the following example.

EXAMPLE 1

By using such plating equipment as shown in the accompanying drawing, industrial nickel plating was performed upon aircraft landing gear components of ultra high strength steel SAE 4340M which had been heat-treated to have a tensile strength of 300 KSI (210 kg f/mm$^2$), under the following conditions.

| Plating Bath Composition and Plating Conditions | |
|---|---|
| $NiSO_4.6H_2O$ | 240 g/l |
| $Na_2SO_4$ | 30 g/l |
| $H_3BO_3$ | 40 g/l |
| pH | 3 ~ 4 |
| Bath temperature | 58° C. |
| Cathode current density | 4 A/dm$^2$ |
| Air bubbling agitation | |
| Plating time | 24 hours |

As the result of the above plating operation, thick plating of a plating thickness 1.1 mm was obtained. The plated surface was smooth and had a dull appearance, and formation of pitting was not observed. By using the above-mentioned plating bath, plating was performed and the internal stress in the plating layer was measured by use of a spiral contractometer (a device for measuring internal stress). The resultant measurement showed a low internal stress of 360 kg f/cm$^2$. The micro Vickers hardness of the plated surface showed Hv 220. Further, by using the above-mentioned plating bath, the nickel plating was performed to 80 μm upon a notched tensile specimen of AISI 4340 steel which had been heat-treated to 260~280 KSI. Without a baking treatment, the plated specimen was held for 200 hours under the static load of 75% ultimate tensile strength (UTS). The plated specimen, however, was not fractured, and it has been proved that no hydrogen embrittlement takes place at all.

EXAMPLE 2

Same plating experiment as EXAMPLE 1, except using a plating solution which eliminates sodium sulfate from the bath composition of EXAMPLE 1, was carried out in order to confirm the effect of sodium sulfate on hydrogen embrittlement characteristics of the nickel plating bath. Plating bath composition and plating conditions were as follows;

| | |
|---|---|
| $NiSO_4.6H_2O$ | 240 g/l. |
| $H_3BO_3$ | 40 g/l. |
| pH | 3-4 |
| Bath temperature | 58° C. |
| Cathode current density | 4 A/dm$^2$ |
| Air bubbling agitation | |
| Plating time | 24 hours |

As a result of the above plating operation, nickel plating having the same quality in appearance, internal stress and hardness as EXAMPLE 1 was obtained. However in a hydrogen embrittlement test a notched tensile specimen the same as in EXAMPLE 1 failed after 43 hours loading. The plated specimen was fractured at the notch portion. It has been proved that the nickel plating bath which does not contain sodium sulfate caused hydrogen embrittlement. It has been obviously proved that existence of sodium sulfate in the plating bath of the present invention shows the effect of elimination of hydrogen embrittlement. The effect of sodium sulfate in the plating bath of the present invention will be explained that during electrolysis sodium sulfate is oxidized at the surface of the lead anode and produces sodium persulfate. This sodium persulfate will oxidize the nascent hydrogen to water at the surface of the plating substrate (cathode). This will eliminate hydrogen penetration into the base metal of the substrate, therefore hydrogen embrittlement is inhibited in this process.

EXAMPLE 3

In order to evaluate the effect of sodium sulfate on hydrogen embrittlement characteristics of the nickel plating bath, Boeing Hydrogen Detection Instrument tests were carried out and the results are shown in Table 1. Boeing Hydrogen Detection Instrument Testing is an electronic evaluation test method which has bee used widely in the aircraft industry in order to make an evaluation of hydrogen embrittlement characteristics of various plating baths. The λ (Lambda) value which is obtained from this test is a parameter of the degree of hydrogen embrittlement, if λ has a value less than 100, the tested plating bath will be determined as low hydrogen embrittlement. If the λ value exceeds 100, the tested bath will be of high hydrogen embrittlement.

The following plating baths have been used for these tests. Bath composition was as follows and conditions are the same as in EXAMPLE 1.

| | |
|---|---|
| $NiSO_4.6H_2O$ | 240 g/l. |
| $H_3BO_3$ | 40 g/l. |

TABLE 1

| Amount of $Na_2SO_4$ | λ value of the test | Internal stress of deposit |
|---|---|---|
| 0 g/l. | 280 | + 300 kgf/cm$^2$ |
| 10 g/l. | 160 | + 330 kgf/cm$^2$ |
| 20 g/l. | 100 | + 350 kgf/cm$^2$ |
| 30 g/l. | 98 | + 360 kgf/cm$^2$ |
| 40 g/l. | 92 | + 375 kgf/cm$^2$ |
| 80 g/l. | 90 | + 420 kgf/cm$^2$ |
| 100 g/l. | 85 | + 510 kgf/cm$^2$ |
| 120 g/l. | 80 | + 530 kgf/cm$^2$ |
| 150 g/l. | 79 | + 600 kgf/cm$^2$ |
| 180 g/l. | 79 | + 860 kgf/cm$^2$ |
| 200 g/l. | 78 | + 1050 kgf/cm$^2$ |

According to the experimental data shown in TABLE 1, the bath not containing sodium sulfate shows a λ value of more than 100. Therefore this bath will cause hydrogen embrittlement for ultra high strength steel substrates. 10 g/l. of sodium sulfate will be insufficient to prevent hydrogen embrittlement, however above 20 g/l. of sodium sulfate containing baths show λ values of less than 100 and therefore will produce low hydrogen embrittlement nickel plating. Increasing sodium sulfate content in the bath, however, causes increasing internal stress of the nickel deposit. Internal stress of above +600 kgf/cm$^2$ should be avoided in order to avoid loss of fatigue strength. Therefore the content amount of sodium sulfate shall be 20–150 g/l.

Through the above experiments it has been proved that the industrial nickel plating according to the present invention was satisfactory for repair plating upon aircraft ultra high strength steel components.

As described with respect to the above example, the present invention can solve the problems in the industrial nickel plating by a conventional nickel sulfamate plating method and provides a method of nickel plating suitable to repair of aircraft ultra high strength steel components which can be carried out easily and inexpensively. Thus, the present invention is a significant one.

It is obvious that various changes and modifications may be made in the present invention without departing from the spirit and scope thereof. It is therefore understood that the present invention be not limited by any of the details of description, unless otherwise specified, but rather be construed broadly within its spirit and scope as set out in the accompanying claims.

What is claimed is:

1. A method of industrial low hydrogen embrittlement nickel plating by using an insoluble anode, comprising the steps of:

preparing a plating bath composed of 200–350 g/l nickel sulfate, 30–50 g/l boric acid and 20–150 g/l sodium sulfate; and performing plating in said plating bath while making electrolysis by using a lead anode as said insoluble anode and while supplying nickel carbonate slurry into said plating bath to thereby cause the nickel carbonate to dissolve in a plating solution in said plating bath under control of pH value of said plating solution within a range of from 2 to 5.

2. A method according to claim 1, in which the content of sodium sulfate of said plating solution is a range of from 40 g/l to 120 g/l.

* * * * *